US008581157B2

(12) United States Patent
Springer et al.

(10) Patent No.: US 8,581,157 B2
(45) Date of Patent: Nov. 12, 2013

(54) BAND HEATER SYSTEMS AND ASSEMBLY METHODS

(75) Inventors: Stacy Springer, Murfreesboro, TN (US); Ronald R. Barnes, Murfreesboro, TN (US); Robert Cockrell, Murfreesboro, TN (US); Lucas L. Fowler, Murfreesboro, TN (US); Alvin L. Slayton, Lascassas, TN (US)

(73) Assignee: Backer EHP Inc., Murfreesboro, TN (US)

( * ) Notice: Subject to any disclaimer, the term of this patent is extended or adjusted under 35 U.S.C. 154(b) by 612 days.

(21) Appl. No.: 12/627,622

(22) Filed: Nov. 30, 2009

(65) Prior Publication Data

US 2010/0320185 A1 Dec. 23, 2010

Related U.S. Application Data

(60) Provisional application No. 61/218,716, filed on Jun. 19, 2009.

(51) Int. Cl.

| | |
|---|---|
| ***H05B 1/00*** | (2006.01) |
| ***B66F 19/00*** | (2006.01) |
| ***H01R 13/62*** | (2006.01) |

(52) U.S. Cl.

USPC ..... 219/542; 219/546; 219/549; 219/528; 219/534; 242/149; 267/74; 24/20 S; 24/31 F; 24/32

(58) Field of Classification Search

USPC ..... 219/542

See application file for complete search history.

(56) References Cited

U.S. PATENT DOCUMENTS

| | | | | |
|---|---|---|---|---|
| 1,588,471 | A | 6/1926 | Bezkorowajnyj | |
| 1,642,197 | A * | 9/1927 | Fowler | 219/528 |
| 1,664,647 | A | 4/1928 | Sundstrand | |
| 2,013,595 | A | 9/1935 | Barnard | |

(Continued)

FOREIGN PATENT DOCUMENTS

| | | |
|---|---|---|
| DE | 405216 | 10/1924 |
| DE | 3139037 | 4/1983 |

(Continued)

OTHER PUBLICATIONS

International Search Report and Written Opinion of the International Searching Authority for PCT/US2010/047517, dated May 13, 2011 (9 pages).

(Continued)

*Primary Examiner* — Jerome Jackson, Jr.

(74) *Attorney, Agent, or Firm* — Neal, Gerber & Eisenberg LLP

(57) ABSTRACT

A band heater assembly for heating an object includes a band heater that extends around at least a portion of a perimeter of the object. The band heater includes a cable and a band. The cable includes a resistive element, a first cable end and a second cable end. The resistive element generates thermal energy based on a current received from a power source. The first cable end and the second cable end are connected to respective ends of the band heater assembly. The band is connected to the cable and transfers a first portion of the thermal energy to an exterior surface of the object. At least a portion of the cable is exposed from the band heater to contact the exterior surface when the band heater assembly is connected to the object.

10 Claims, 11 Drawing Sheets

(56) References Cited

U.S. PATENT DOCUMENTS

| | | | | | |
|---|---|---|---|---|---|
| 2,400,425 | A | | 5/1946 | Liber | |
| 2,817,742 | A | | 12/1957 | Drugmand | |
| 3,453,417 | A | * | 7/1969 | Hummel | 219/536 |
| 4,529,179 | A | | 7/1985 | Seyler | |
| 4,557,441 | A | * | 12/1985 | Aspinall | 244/129.4 |
| 4,794,229 | A | * | 12/1988 | Goss et al. | 219/548 |
| 4,912,303 | A | * | 3/1990 | Beavers et al. | 219/535 |
| 5,692,599 | A | | 12/1997 | Winter | |
| 5,883,995 | A | * | 3/1999 | Lu | 385/60 |
| 6,098,970 | A | | 8/2000 | Lowe | |
| 6,232,577 | B1 | | 5/2001 | Reiff | |
| 6,557,620 | B2 | | 5/2003 | Oshimo | |
| 6,844,531 | B2 | | 1/2005 | Kirby | |
| 7,080,829 | B2 | | 7/2006 | Requet | |
| 7,345,954 | B2 | * | 3/2008 | Ehrsam et al. | 368/10 |
| 2004/0211770 | A1 | * | 10/2004 | Renwick et al. | 219/541 |

FOREIGN PATENT DOCUMENTS

| | | |
|---|---|---|
| EP | 1650386 | 4/2006 |
| GB | 283312 | 1/1928 |
| JP | 01-272082 | 10/1989 |
| JP | 02-018298 | 2/1990 |
| JP | 2003068430 | 3/2003 |
| JP | 2004-205025 | 7/2004 |
| JP | 2005093746 | 4/2005 |
| JP | 2005190921 | 7/2005 |
| JP | 2005-211922 | 8/2005 |

OTHER PUBLICATIONS

International Preliminary Report on Patentability for PCT/US2010/047517, dated Jun. 5, 2012 (7 pages).

Extended European Search Report for European Patent Application No. 1219506.0—1808, dated Feb. 15, 2013 (5 pages).

Extended European Search Report for European Patent Application No. 1219508.6—1808, dated Feb. 15, 2013 (6 pages).

* cited by examiner

BAND HEATER SYSTEMS AND ASSEMBLY METHODS

FIELD

The present disclosure relates to heaters for objects, such as crankcases of heating, ventilation and air conditioning (HVAC) systems.

BACKGROUND

The background description provided herein is for the purpose of generally presenting the context of the disclosure. Work of the presently named inventors, to the extent the work is described in this background section, as well as aspects of the description that may not otherwise qualify as prior art at the time of filing, are neither expressly nor impliedly admitted as prior art against the present disclosure.

A compressor of a heating, ventilation and air conditioning (HVAC) system includes a motor that increases temperature of a refrigerant, such as freon, through compression. Oil within the compressor is used for lubrication of internal bearings and other motor components. The refrigerant changes from a gaseous state to a liquid state when the temperature of the compressor decreases below a threshold (e.g. 40° F.). The temperature of the refrigerant may decrease below the threshold, for example, when the compressor is in an environment with an ambient temperature that is less than the threshold and/or when the compressor is in an idle or OFF state. The refrigerant can mix with and dilute the oil when in a liquid state. This negatively affects properties of the oil and degrades lubrication of the motor components, as well as causes "slugging". Slugging refers to attempts by the compressor to compress a refrigerant and/or oil in a liquid state. During slugging the compressor may operate erratically and inefficiently. Compressors are generally designed to compress a gas, not a liquid. Thus, decreases in refrigerant temperature below a threshold can negatively affect the operation of a compressor, as well as decrease the life span of compressor components.

To prevent oil dilution, a band heater may be applied to an exterior surface of a compressor crankcase. The band heater is used to heat the crankcase and thus a refrigerant contained therein. The band heater may be used to maintain the temperature of the refrigerant above a temperature at which the refrigerant changes from a gas to a liquid.

A first example band heater assembly includes a cable and a stainless steel tube that has fingers that extend laterally from the tube. The cable extends through and is contained within the stainless steel tube. The fingers are used to transfer heat generated by the cable to a compressor crankcase. The fingers have sharp edges, which raises handling and ergonomic issues. This band heater assembly exhibits a limited amount of heat transfer from the cable to the compressor crankcase.

A second example band heater assembly includes a first end and a second end. A resistive element extends from a first end to the second end and back to the first end. In other words, the resistive element has two passes over the length of the band heater assembly. The ends include rivets, washers, and brackets, which are used to connect the band heater assembly to a crankcase. Use of the rivets, washers, and brackets increases assembly complexity and material costs. Also, the rivets and washers tend to interfere with the crankcase and cause gaps between the band heater assembly and the crankcase. The gaps reduce heat transfer efficiency and can create hot spots at the ends of the band heater assembly. Portions of the band heater assembly that are not in contact with the crankcase increase in temperature due to lack of heat transfer. This can over time degrade the band heater assembly in the hot spot areas.

The second band heater assembly is also limited in application to an object that has a consistent outer diameter and/or perimeter shape for the lateral width of the band heater assembly. As an example, an object that is cylindrically shaped may have a consistent outer diameter and/or perimeter shape, whereas a spherically shaped object has an inconsistent outer diameter (i.e. diameters of vertical or lateral cross-sectional slices through the sphere) with respect to a band heater assembly. An inconsistent outer diameter and/or perimeter shape can cause buckling and gaps between the band heater assembly and the object, which can also result in hot spot areas.

SUMMARY

In one embodiment, a band heater assembly for heating an object is provided that includes a band heater that extends around at least a portion of a perimeter of the object. The band heater includes a cable and a band. The cable includes a resistive element, a first cable end and a second cable end. The resistive element generates thermal energy based on a current received from a power source. The first cable end and the second cable end are connected to respective ends of the band heater assembly. The band is connected to the cable and transfers a first portion of the thermal energy to an exterior surface of the object. At least a portion of the cable is exposed from the band heater to contact the exterior surface when the band heater assembly is connected to the object.

An end block connector for a band heater is provided and includes a body that is molded over an end of the band heater and that has a multi-sectional passage. The multi-sectional passage includes a first section and a second section. The band heater section retains the end of the band heater. The lead section retains a lead that receives current from a power source. A retaining clip engages with the body and is configured to connect to another end block connector via a fastener.

A tension adjustment assembly includes a tension adjustment handle that connects to a first retaining clip on a first heater end of a band heater and a fastener. The fastener includes a first fastener end that connects to a second retaining clip on a second heater end of the band heater. The fastener also includes a first section that is in tension and a second section that is connected to the tension adjustment handle and to the first section. The tension adjustment handle adjusts the tension of the first section.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF DRAWINGS

The present disclosure will become more fully understood from the detailed description and the accompanying drawings, wherein.

DESCRIPTION

Figure 1:
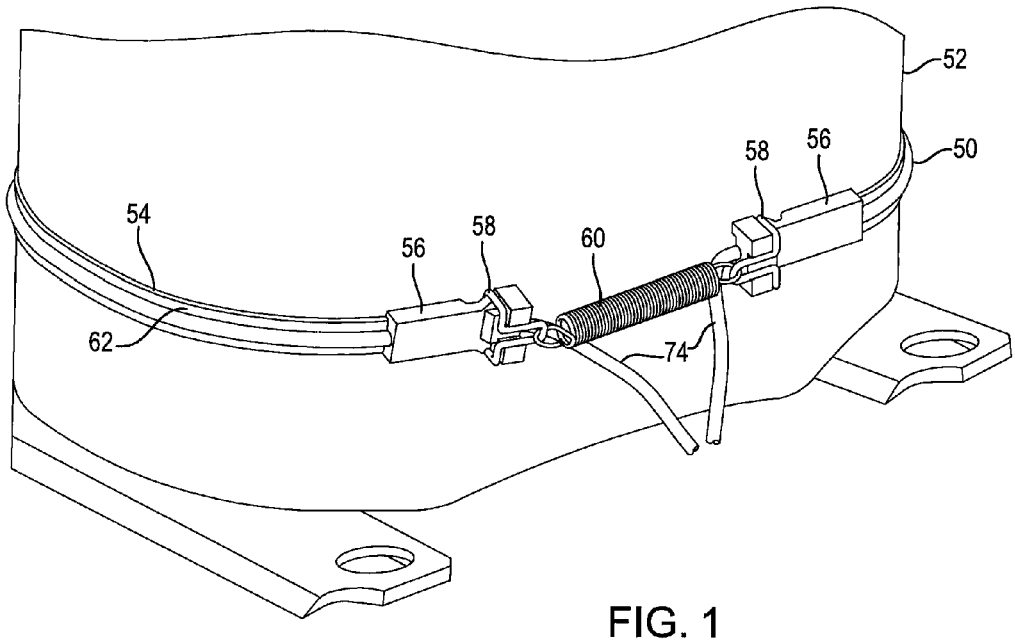
FIG. 1 is a perspective view of a band heater assembly connected on a crankcase in accordance with an embodiment of the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical OR. It should be understood that steps within a method may be executed in different order without altering the principles of the present disclosure.

As used herein, the term module may refer to, be part of, or include an Application Specific Integrated Circuit (ASIC), an electronic circuit, a processor (shared, dedicated, or group) and/or memory (shared, dedicated, or group) that execute one or more software or firmware programs, a combinational logic circuit, and/or other suitable components that provide the described functionality.

In the following disclosed embodiments various dimensions and relationships between elements are described. The dimensions and relationships may be based on various longitudinal, lateral, and vertical directions associated with a band heater assembly. A longitudinal direction may refer to a dimension along and/or in parallel with a longitudinal axis of a band heater assembly that extends, for example, between ends, leads, clamp elements, and/or end block connectors (e.g. overmold blocks) of a the band heater assembly. A lateral direction may be perpendicular to the longitudinal direction and along and/or in parallel with a lateral axis of the band heater assembly that extends, for example, between edges of a band and/or between lateral sides of end block connectors (e.g. overmold blocks). A vertical direction may be perpendicular to the longitudinal and lateral directions and along and/or in parallel with a vertical axis of the band heater assembly. The vertical axis may, for example, between upper and lower surfaces of a band heater and/or an end block connector (e.g. overmold block).

Also, in the following description, various band heater assemblies are disclosed. The band heater assemblies may be used for compressor crankcase heating of a HVAC system, heating of an object within a refrigeration system, commercial barrel and nozzle heating, etc.

Figure 2:
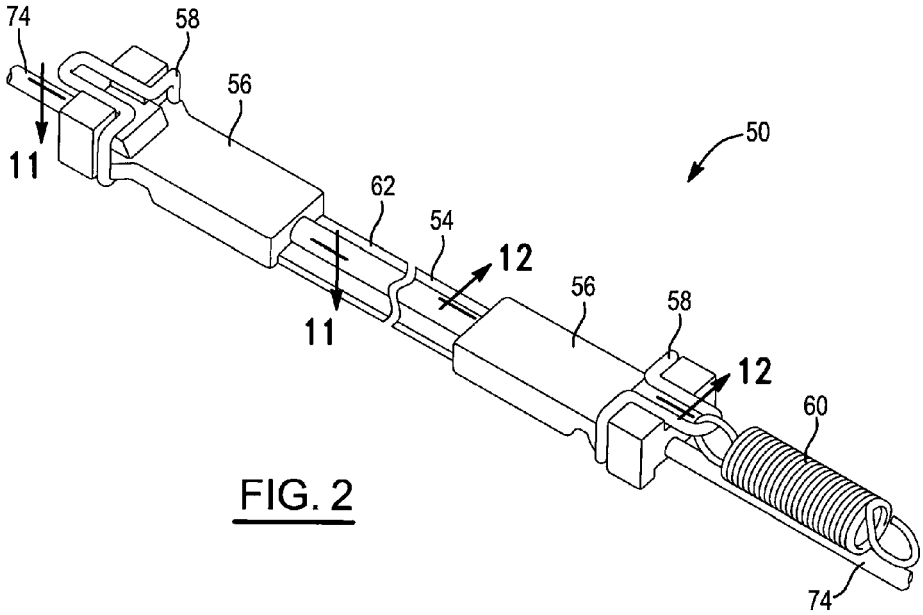
FIG. 2 is another perspective view of the band heater assembly of FIG. 1 in a disconnected state.

In FIGS. 1 and 2, perspective views of a band heater assembly 50 are shown. The band heater assembly 50 may be connected to various objects, such as a compressor crankcase (heated object) 52, as shown in FIG. 1. In FIG. 1, the band heater assembly 50 is shown in a connected state on an exterior surface of the heated object 52. In FIG. 2, the band heater assembly 50 is shown in a disconnected state.

Figure 3:
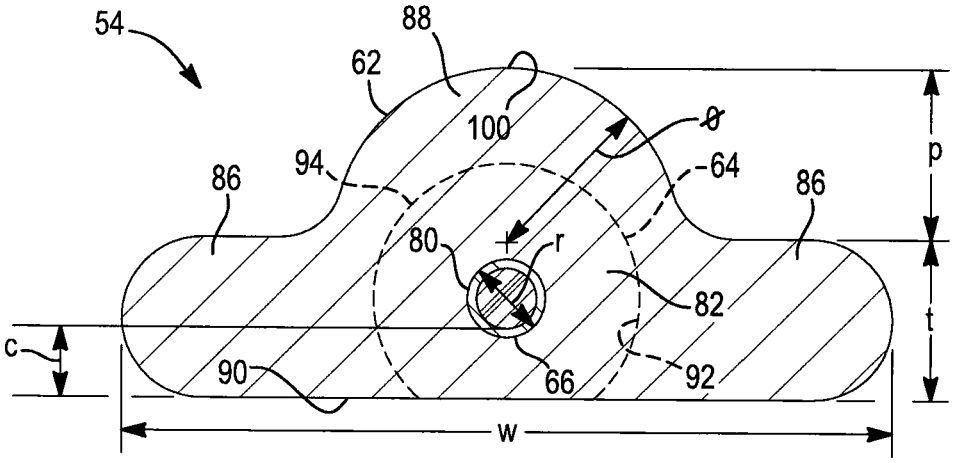
FIG. 3 is a cross-sectional view of a band heater in accordance with an embodiment of the present disclosure.
Figure 4:
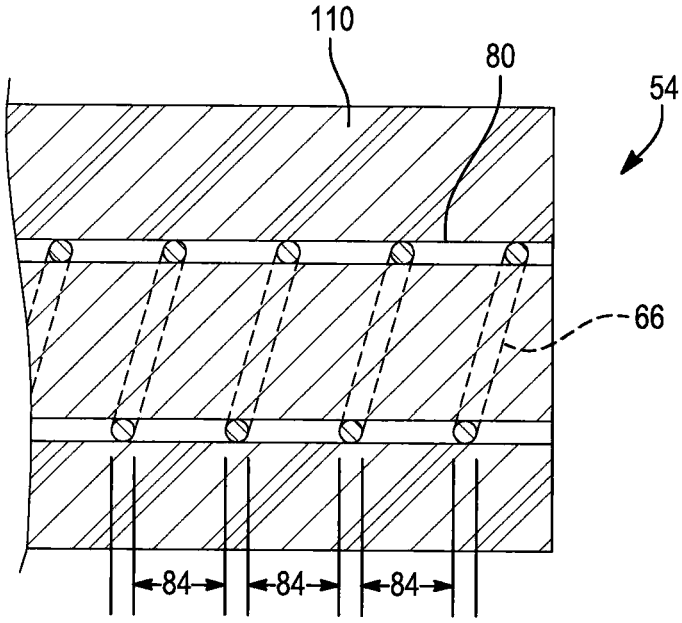
FIG. 4 is a sectional view of the band heater through section line 4-4 of FIG. 3.

The band heater assembly 50 includes a band heater 54, two end block connectors or overmold blocks 56 with retainer clips 58 and a fastener 60. In use, the band heater assembly 50 is wrapped around the heated object 52 and held in place via the fastener 60. The band heater 54 includes a band 62 and a cable 64 (not shown in FIGS. 1 and 2). In the embodiment of FIGS. 1 and 2, the cable 64 is an integral part of the band 62 and is best seen in FIG. 3. The cable 64 extends longitudinally between the overmold blocks 56, includes cable ends that are connected to and/or contained within the overmold blocks 56, and includes a resistive element. In the embodiment of FIGS. 1 and 2, the cable ends correspond to band heater ends 70 (shown in FIGS. 11 and 12). An example resistive element 66 is shown in FIGS. 3 and 4.

The overmold blocks 56 are formed over the band heater ends 70, which may correspond to cable ends of the band heater 54 and engage with the retaining clips 58. The retaining clips 58 are connected to each other via the fastener 60. For example only, the biasing member or fastener 60 may be an extendable spring. The fastener 60 may be in a state of tension and may be extended to connect to the retaining clips 58. The tension of the fastener 60 holds the band heater assembly 50 in place on the heated object 52. Leads 74 extend from the overmold blocks 56 and are used to provide electrical current to the resistive element of the band heater 54. The leads 74 may be referred to as lead cables.

In FIG. 3, a cross-sectional view of the band heater 54 is shown. The band heater 54 includes the band 62 and the cable 64. The cable 64 includes a core 80, the resistive element 66, and a jacket 82. The core 80 may be formed of an insulative material, such as fiberglass or a dielectric material, and is used to provide flexibility and a support structure on which the resistive element 66 may be wound. The resistive element 66 may be wound on the core 80 and include gaps 84 between coils, referred to as coil gaps, as shown in FIG. 4. The size of the coil gaps 84 may be varied to alter heat output of the resistive element 66.

The jacket 82 may electrically insulate and protect the resistive element 66 and allow for good heat or thermal energy transfer between the resistive element 66 and a heated object 52. The jacket 82 may, for example, be formed of a non-metallic and non-electrically conductive material, such as rubber, silicone rubber, glass impregnated rubber, synthetic fluoropolymer, polytetrafluroethylene, a dielectric material, etc. The jacket 82 may be formed to withstand temperatures greater than approximately 150° C.

The band 62 includes one or more flanges 86 and a center section 88 that protrudes away from a bottom contact surface 90. When the band heater assembly 50 is connected to a heated object 52, the bottom contact surface 90 is in direct contact with the heated object 52. In the embodiment shown, the band 62 includes two flanges that extend from opposite sides of the center section 88. The center section 88 may be in the shape of a channel and have an inner side 92 that matches the outer peripheral shape of the jacket 82.

In the embodiment shown, the band 62 and the jacket 82 are integrally formed as a single item. The term "integrally formed" refers to the formation of two or more items as a unitary structure. When two or more items are integrally formed, the items may be formed during the same time period, using the same materials, and using the same manufacturing processes. As the band 62 and the jacket 82 are formed as a single item the band 62 is integrally formed as part of the cable 64. The band 62 and the jacket 82 may be extruded and/or formed over the resistive element 66. The band 62 may, for example, be formed of the same material as the jacket 82 and/or may be formed of a non-metallic and non-electrically conductive material, such as rubber, silicone rubber, glass impregnated rubber, synthetic fluoropolymer, polytetrafluroethylene, etc. and/or may be formed of a metallic electrically conductive material, such as aluminum, steel, stainless steel, copper, silver, etc. In one example embodiment, the band 62 is formed of aluminum and the jacket 82 is formed of silicone rubber.

Figure 13:
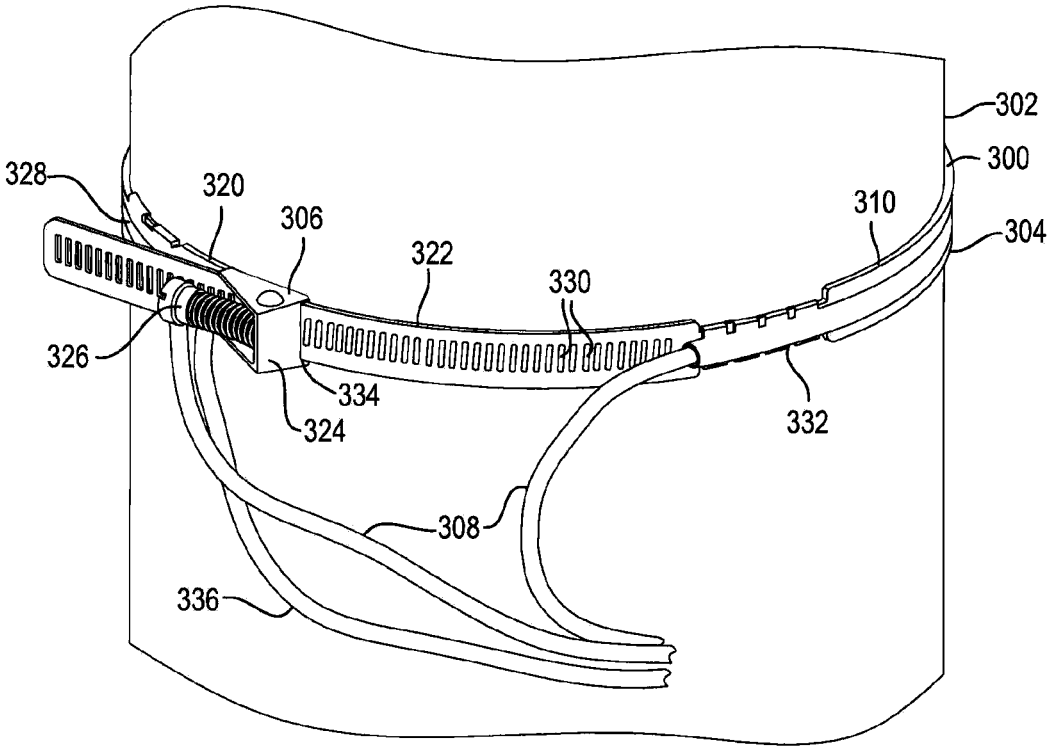
FIG. 13 is a perspective view of another band heater assembly in accordance with an embodiment of the present disclosure.
Figure 14:
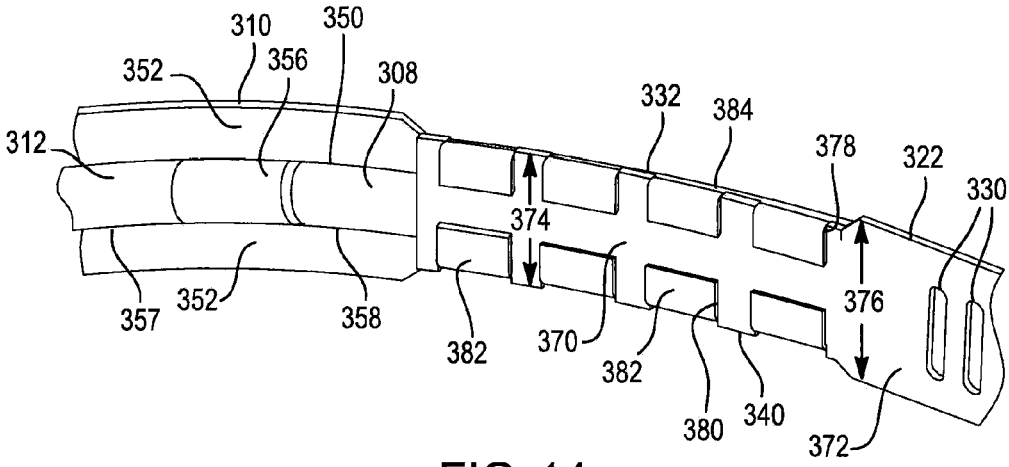
FIG. 14 is a bottom perspective view of a portion of the band heat assembly of FIG. 13.
Figure 15:
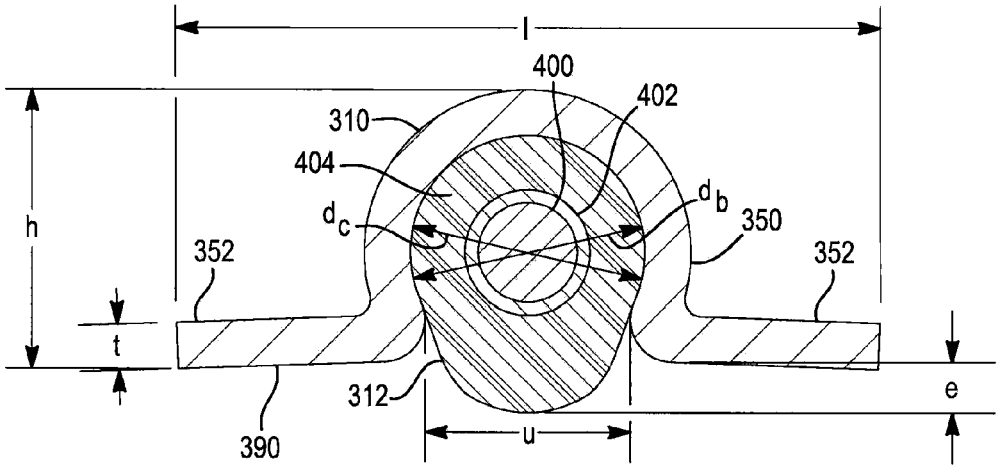
FIG. 15 is a cross-sectional view of another band heater in accordance with an embodiment of the present disclosure.

The band 62 and the jacket 82 may be formed as separate distinct items that are engaged and/or formed in succession during manufacturing. A dividing line 94 is provided to distinguish between the band 62 and the jacket 82. When the band 62 and the jacket 82 are formed as separate items, the cable 64 may be press fit into the band 62 and/or may protrude from the band 62 on the same side of the band heater 54 as the bottom contact surface 90. An example of a band heater assembly that includes a distinct band and cable is shown in FIGS. 13-15.

Referring again to FIG. 3, the flanges 86 extend laterally from the cable 64 and provide an increased contact surface area for the transfer of thermal energy to the heated object 52. The flanges 86 may be of varying length. The flanges 86 are integrally formed as part of the band 62 and/or cable 64.

The band heater 54 includes a resistive element to contact surface dimension c, a lateral width dimension w, a flange thickness t, a protrusion height p of the center section, a resistive element diameter r, and a protrusion radius Ø.

The resistive element to contact surface dimension c corresponds to an offset of the resistive element 66 and/or core 80 within the band heater 54. The resistive element 66 and/or the core 80 is offset towards the bottom contact surface 90 or side of the band heater 54 that is in contact with the heated object 52. This improves thermal energy transfer to the heated object 52. The resistive element 66 and the core 80 are closer to the bottom contact surface 90 than to an outer surface 100 of the center section 88. In one embodiment, the resistive element to contact surface dimension c is greater than or equal to a predetermined value x. In another embodiment, the predetermined value x is approximately equal to 0.03-0.04 inches.

The lateral width dimension w may be referred to as an extruded dimension and is greater than the protrusion height p of the center section 88. This aids in providing contact with the heated object 52 while maintaining a predetermined width for efficient thermal energy transfer from the resistive element 66 to the heated object 52. The center section 88 provides stability and allows for proper orientation of the band heater 54. The center section 88 provides structural support and prevents twisting of the band heater 54.

The flange thickness t is sized to facilitate heat transfer while providing mechanical strength. The flanges 86 may also be used for orienting the band heater 54. The protrusion height p is sized to provide a visual aide for installation. The resistive element diameter r is the outer diameter of the resistive element 66 as coiled on the core 80. The resistive element diameter r is sized for efficient material usage. In one embodiment, the resistive element 66 is approximately 0.03-0.04 inches from the bottom contact surface 90. A protrusion diameter 2Ø may be equal to the resistive element diameter r plus 0.03 inches. This provides protection of the resistive element 66. The protrusion diameter 2Ø is greater than the flange thickness t.

Figure 16:
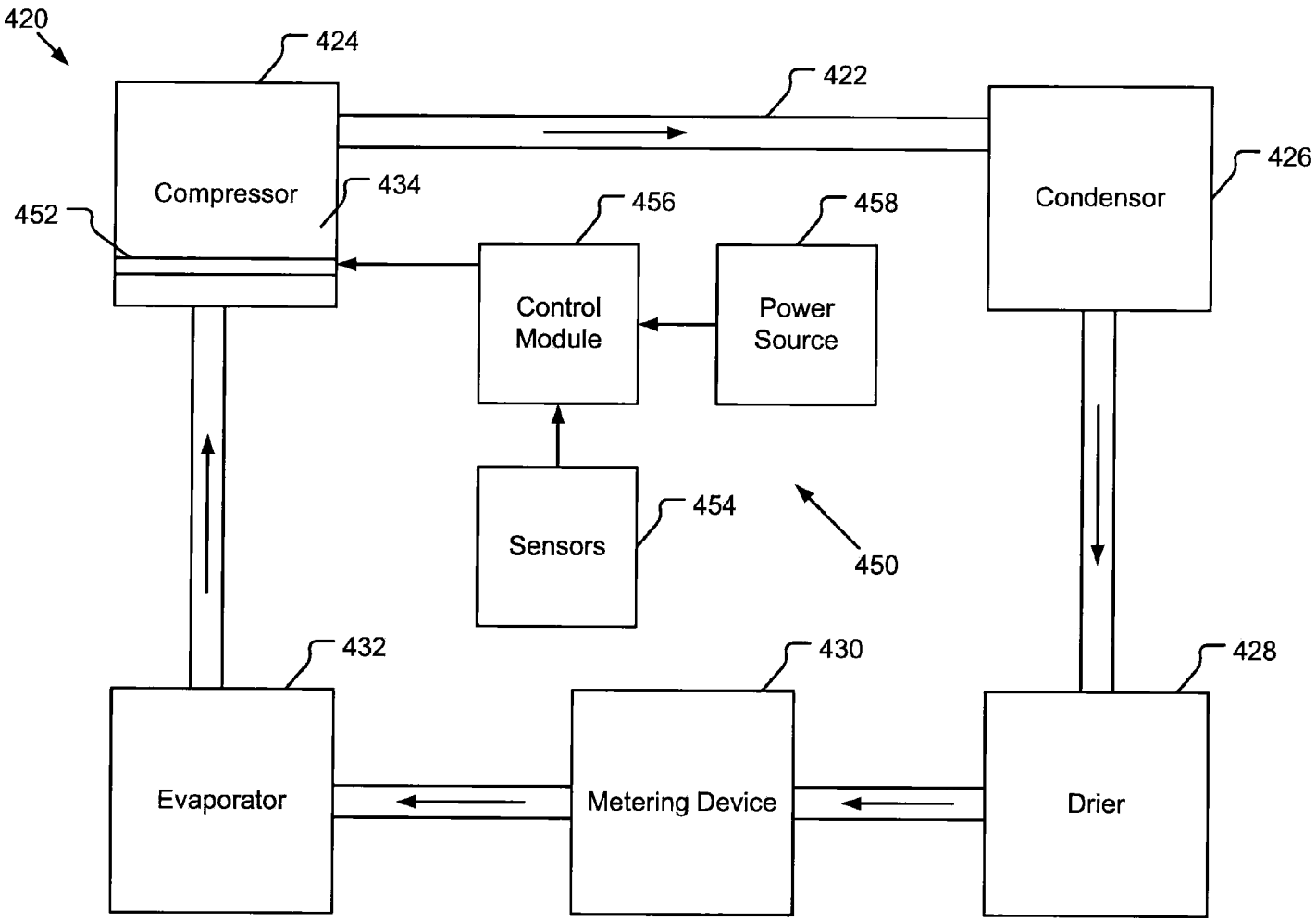
FIG. 16 is a block diagram of a HVAC system incorporating a band heater assembly in accordance with an embodiment of the present disclosure.

In use, the resistive element 66 receives electrical current from a power source. An example power source is shown in FIG. 16. As the temperature of the resistive element 66 increases, a portion of the thermal energy generated by the resistive element 66 is transferred from the resistive element 66 to the jacket 82 and in turn to the band 62.

The configuration and material makeup of the cable 64 and use of a single cable that extends between end block connectors or overmold blocks (referred to as a single pass cable) provides flexibility and application variability. In other words, the band heater assembly 50 may be applied to objects of various dimensions and shapes. Also, the configuration, material makeup, and flexibility of the band heater assembly 52 prevents buckling and provides a consistent and continuous contact relationship between the band heater 54 and the heated object 52. For example, the band heater assembly 50 may be applied to cylindrically-shaped objects, spherically-shaped objects, and objects with varying diameters (i.e. diameters of vertical or lateral cross-sectional slices through the objects) and/or perimeter sizes while minimizing gaps between the band heater 54 and the heated object 52. The band 62 and/or cable 64 of the band heater 54 may provide consistent and continuous contact with an object that has varying diameter over lateral width of the band heater 54. The configuration of the overmold blocks 56 and the retainer clips 58 also minimizes gaps between the band heater assembly 50 and the heated object 52 when the band heater assembly 50 is connected to the heated object 52.

In FIG. 4, a sectional view of the band heater 54 of FIG. 3 is shown. The band heater 54 includes an insulative body 110, which may include the band 62 and jacket 82. Within the insulative body 110 includes the resistive element 66 that is wound around the core 80. Distances between the gaps 84 of the resistive element 66 may be adjusted to alter resistance and/or heat production of the resistive element 66. The resistive element 66 may include one or more wire strands and be formed of one or more conductive materials, such as copper, silver, etc.

Figure 5:
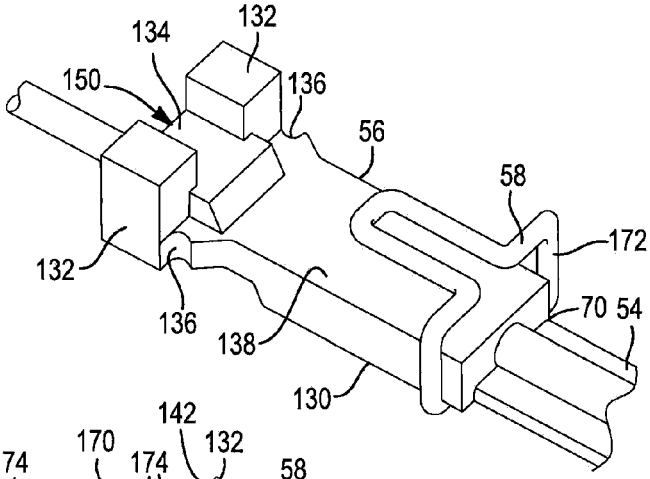
FIG. 5 is a perspective view of an end block connector with a retaining clip in a disengaged state in accordance with an embodiment of the present disclosure.
Figure 6:
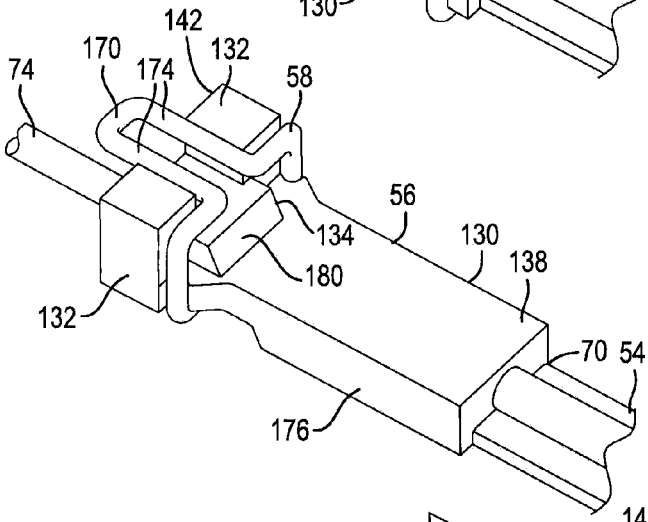
FIG. 6 is a perspective view of the end block connector of FIG. 5 with the retaining clip in an engaged state.

In FIGS. 5-8, one of the overmold blocks 56 and an end block connector or overmold block 56' are shown. In FIG. 5, one of the retaining clips 58 is shown in a disengaged state. In FIG. 6, the retaining clip 58 is shown in an engaged state. The retaining clip 58 slides over, engages and locks with the overmold block 56. The design of the overmold block 56 and the retaining clip 58 prevents interference between the retaining clip 58 and the heated object 52.

The overmold block 56 includes a main body 130, two or more stoppers 132, one or more retaining clip guides 134, and one or more notches 136. The overmold block 56 also includes an upper side 138 and a lower side or contact surface side 140 that opposes the upper side 138. The contact surface side 140 contacts the heated object 52 when the belt heater assembly 50 is installed. The overmold block 56 includes various sections and elements and may be formed as a single item or may be formed of separate items that are connected together. The features of the overmold block 56 provide centering and position alignment of the retainer clip 58.

The main body 130 is molded over and/or connected to one of the band heater ends 70 of the band heater 54. The main body 130 may be integrally formed with the stoppers 132, retaining clip guides 134, and the notches 136. The stoppers 132 are located on a block end 142 of the overmold block 56 nearest the lead 74. The stoppers 132 provide a fixed surface and support for the retaining clip 58, which when engaged is adjacent to and in contact with the stoppers 132. The stoppers 132 are used to lock the retaining clip in a fixed position. The stoppers 132 protrude upward from the main body 130 to form an upper center recessed section 150 and downward from the main body 130 to form one or more lower recessed sections 152. The upper center recessed section 150 is on the upper side 138.

Figure 7:
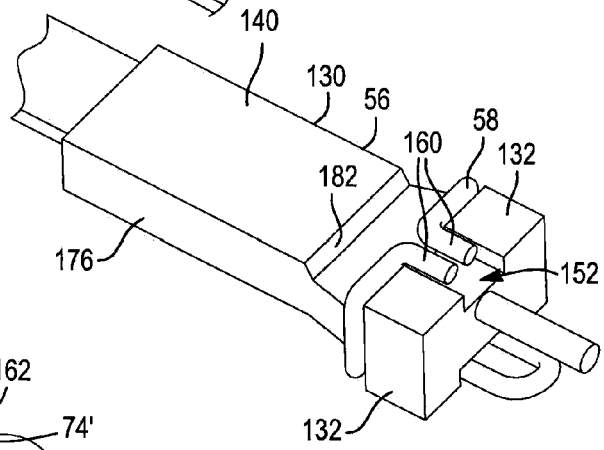
FIG. 7 is a bottom perspective view of an end block connector in accordance with an embodiment of the present disclosure.
Figure 8:
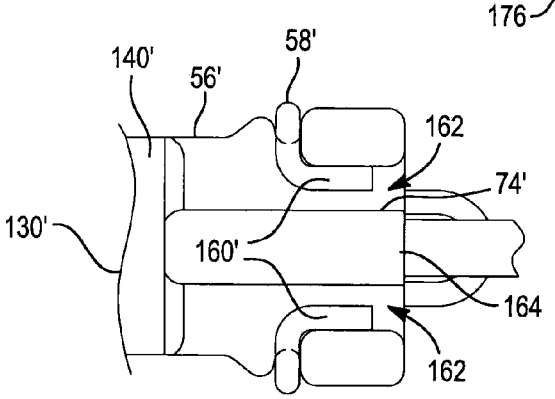
FIG. 8 is bottom view of another end block connector in accordance with an embodiment of the present disclosure.
Figure 11:
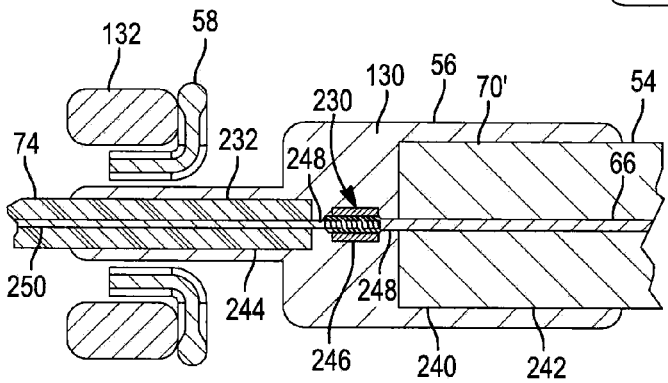
FIG. 11 is a lateral cross-sectional view of a portion of the band heater assembly through section line 11-11 of FIG. 2.
Figure 12:
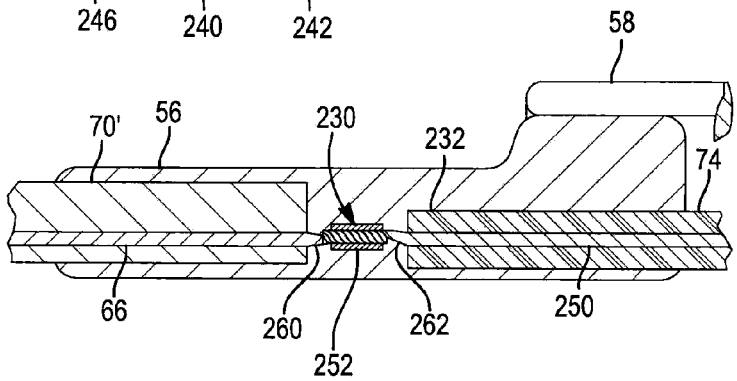
FIG. 12 is a vertical cross-sectional view of another portion the band heater assembly through section line 12-12 of FIG. 2.

In FIG. 7, the overmold block 56 is shown with a single lower recessed section 152. In the embodiment of FIG. 7, ends 160 of the retaining clip 58 are slid into the lower recessed section 152 which is centralized on the main body 130. FIG. 8 shows the overmold block 56' with dual lower recessed sections 162. The dual lower recessed sections 162 are separated by a lead protector 164 that is in line with a lead 74' and extends along a contact surface side 140'. The lead protector 164 may be integrally formed as part of a main body 130' of the overmold block 56' and protrude between the dual lower recessed sections 162. A lead section of the overmold block 56' and/or an end of the lead 74' may alternatively or additionally extend between the dual lower recessed sections 162. An example of the lead section is shown in FIGS. 11 and 12. In the embodiment of FIG. 8, ends 160' of a retaining clip 58' are slid into respective ones of the lower recessed sections 162.

The retaining clips 58 include the ends 160, a center section 170, and two side wrapping sections 172, as identified in FIGS. 5-7. The retaining clip 58' has similar sections. The center section 170 is folded or looped to provide two opposing wire sections 174. The center section 170 slides over and into the upper center recessed section 150. The two wrapping sections 172 wrap around lateral sides 176 of the overmold block 56 and slide into the notches 136, which are on the lateral sides 176. The retaining clip 58 is locked into position when engaged with the notches 136. The notches 136 and the stoppers 132 prevent movement of the retaining clip 58 in longitudinal directions. The two ends 160 slide into the one or more lower recessed sections 152.

The retaining clip guides 134 position the retaining clip 58 during engagement with the overmold block 56. In the embodiment of FIGS. 5-7, a first ramp guide 180 is provided on the upper side 138 between the stoppers 132. A second ramp guide 182 is provided on the lower side 140, may be in alignment with the lower recessed section 152, is adjacent to the notches 136, and is on an opposite side of the notches 136 than the stoppers 132.

Figure 9:
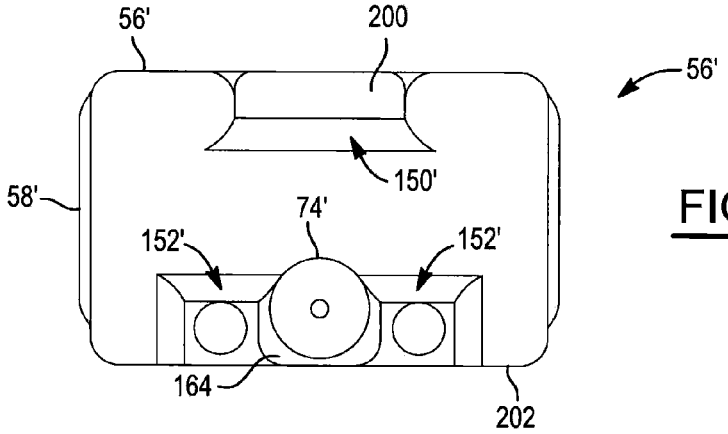
FIG. 9 is an end view of the end block connector of FIG. 8.

In FIG. 9, an end view of the overmold block 56' of FIG. 8 is shown. A center section 200 of the retaining clip 58' is positioned in an upper recessed section 150' of the overmold block 56'. The ends 160' are positioned in dual lower recessed sections 152' on opposite sides of the lead 74'. The lead protector 164 provides a layer of insulation and protection between the lead 74' and a contact surface 202 of the overmold block 56'. The lead 74' is offset towards the contact surface 202 to align with the cable 64 (shown in FIG. 3) and an opposite end of the overmold block 56'.

Figure 10:
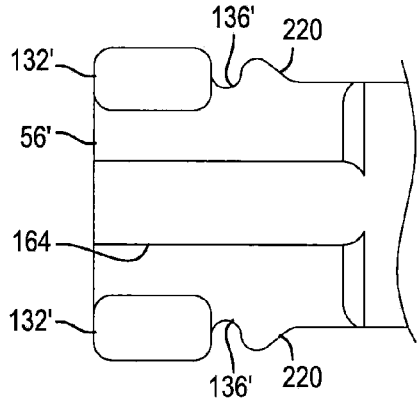
FIG. 10 is a bottom view of the end block connector of FIG. 8.

In FIG. 10, a bottom view of the overmold block 56' of FIG. 8 is shown without retaining clip engagement. FIG. 10 illustrates the main body 130', the dual lower recessed sections 152', stoppers 132', notches 136', and the lead protector 164 of the overmold block 56'. The main body 130' may include tapered sides 220. The tapered sides 220 allow for easy installation of the retaining clip 58'. The tapered sides 220 separate wrapping sections of the retaining clip 58' and allow the retaining clip 58' to slide into the notches 136'.

In FIGS. 11 and 12, lateral and vertical cross-sectional views of portions of the band heater assembly 50 of FIG. 2 are shown. The band heater assembly 50 includes the band heater 54 and the leads 74, which are connected at junctions 230. The ends of the band heater 54 (band heater ends 70), ends of the leads 74 (lead ends 232) and the junctions 230 are retained within respective one of the overmold blocks 56. Although one of each of the band heater ends 70, lead ends 232, junctions 230 and overmold blocks 56 are shown in each of FIGS. 11 and 12, the other band heater end, lead end, junction and overmold block may be configured similarly.

The overmold block 56 includes the main body 130 that has a multi-sectional passage 240, which extends longitudinally through the main body 130. The multi-sectional passage 240 includes a band heater section 242, a lead section 244, a junction section 246, and multiple separator sections 248 that have inner dimensions that correspond respectively with dimensions of the band heater 54, the lead end 232, the junction 230, and the resistive elements 66, 250. The band heater section 242 retains the band heater end 70 of the band heater 54. The lead section 244 retains the lead end 232. The junction section 246 retains the junction 230 between the resistive element 66 and a second resistive element 250 of the lead 74, which may be referred to as a lead wire. The first and second resistive elements 66, 250 may be spliced together and inserted in, for example, a barrel or other element that can be crimped. A crimp element 252 is shown. When the resistive elements 66, 250 are spliced together, the spliced combination of the resistive elements 66, 250 may be referred to as a spliced junction.

The separator sections 248 may be located between the band heater section 242 and the junction section 246 and between the junction section 246 and the lead section 244. A first separator section 260 may include the first resistive element 66 and a second separator section 262 may include the second resistive element 250.

In FIG. 13, a perspective view of another band heater assembly 300 is shown. The band heater assembly 300 is shown connected to a heated object 302, such as a compressor crankcase. The band heater assembly 300 includes a band heater 304, a clamp 306 and leads 308. The band heater 304 includes a heated band 310 and a cable 312, which are best seen in FIG. 14. The cable 312 is press-fit into and protrudes from the heated band 310 to provide consistent and continuous contact with the heated object 302. The leads 308 receive current to heat the cable 312 and in turn heat the heated band 310. Thermal energy is transferred from the heated band 310 and the cable 312 to the heated object 302.

The clamp 306 includes a first clamp band 320, a second clamp band 322, a bracket 324, and a worm gear 326. The first clamp band 320 is connected to a first end 328 of the band heater 304. The second clamp band 322 includes a series of slots 330 and is connected to a second end 332 of the band heater 304. The bracket 324 includes a band guide 334 that receives the second clamp band 322. A ground wire 336 may be connected to the first clamp band 320 or the bracket 324. The worm gear 326 is rotated to slide the second clamp band 322 along the band guide 334. The first and second clamp bands 320, 322 have band heater engaging portions 340 that are received by the ends 328, 332 of the heated band 310. An example of this engagement is shown in FIG. 14.

In FIG. 14, a bottom perspective view of a portion of the band heater assembly 300 is shown. The band heater assembly 300 includes the heated band 304 and the cable 312. The heated band 304 includes a center section 350 and one or more flanges 352 (two are shown) that extend outward away from the center section 350. The center section 350 provides an open channel, which exposes the cable 312 for contact with a heated object. The cable 312 is press-fit within the channel of the heated band 304 and is connected to one of the leads 308 at a junction 356. The junction 356 and an end 358 of the corresponding lead 308 are also inserted and/or press-fit into the channel. Outer insulation of the cable 312, the junction 356 and/or the lead 308 may be formed as separate distinct elements or may be integrally formed as one or more jackets. The junction 356 may include a junction element that may be crimped over ends of resistive elements of the cable 312 and the lead 308, similar to the junction 230 shown in FIGS. 11 and 12. A cable end 357 of the cable 312 is shown adjacent the junction 230.

In FIG. 14, although one of the clamp bands 322 is shown, the other clamp band 320 may be configured similarly. The clamp band 322 includes a band heater engaging portion 370 and a worm gear engaging portion 372. The band heater engaging portion 370 has a first width 374 that is less than a second width 376 of the worm gear engaging portion 370. The band heater engaging portion 370 is segmented to include first and second series of notches 378, 380 on each lateral edge of the band heater engaging portion 370. The notches 378, 380 receive fingers 382 in a strain relief portion 384 of the heated band 310, which extend from the center section or channel 350 and are crimped over edges of the notches 378, 380. The lead 308 extends within the channel 350 in the strain relief portion 384. The lead 308 may be crimped within the channel 350 in the strain relief portion 384, which provides strain relief for the lead 308. The heated band in the strain relief portion 384 may be crimped to encase the lead 308. The channel 350 may be closed in the strain relief portion 384. When the channel 350 is open in the strain relief portion 384, the lead extends between the channel 350 or heated band 310 and the band heater engaging portion 370.

In FIG. 15, a cross-sectional view of the band heater 304 is shown. The heated band 310 may have an "omega"-shaped (Ω) cross-section and the one or more flanges 352 and center section 350 that protrudes away from a contact surface 390. The flanges 352 are angled away from the center section 350 and towards the contact surface 390. The heated band 310 increases thermal energy transfer over use of just the cable 312 to the heated object 302. The heated band 310 may be formed of various materials, such as aluminum, steel, stainless steel, silver, copper, etc. In one embodiment, the heated band 310 is formed of aluminum.

The heated band 310 may be extruded, have a longitudinally circular bend, and may be flexible in the longitudinal and lateral directions. The longitudinal circular bend and longitudinal flexibility allows the heated band to be wrapped around an object having a circular outer perimeter, while minimizing gaps between the heated band and the object. The lateral flexibility and the incorporation of the flanges 352 allows for the heated band 310 to flex and provide consistent and continuous contact with the heated object 302 in longitudinal and lateral directions.

The cable 312 includes a core 400, a resistive element 402 and a jacket 404. The core 400 may be formed of an insulative material, such as fiberglass or a dielectric material, and is used to provide flexibility and a structure on which the resistive element 402 may be wound. The resistive element 402 may be tightly wound on the core 400 or may be wound to include gaps between coils. The size of the coil gaps may be varied. The jacket 404 may electrically insulate and protect the resistive element 402 and allow for good thermal energy transfer between the resistive element 402 and a heated object. The jacket 404 may, for example, be formed of a non-metallic and non-electrically conductive material, such as rubber, silicone rubber, glass impregnated rubber, synthetic fluoropolymer, polytetrafluroethylene, a dielectric material, etc. In one example embodiment, the heated band 310 is formed of aluminum and the jacket 404 is formed of silicone rubber.

The heated band 310 and the cable 312 include a channel opening width u, a cable outer diameter $d_c$, a heated band inner diameter $d_b$, a cable protrusion to heated band contact surface dimension e, a heated band width I, a heated band height h, and a heated band thickness t. Predetermined ratios between the dimensions may be used to size the heated band 310 and the cable 312. The predetermined ratios may be set such that the band 310 and cable 312 are in contact with the heated object along the longitudinal length of the band heater 304.

The cable 312 is oversized and press-fit into the center section 350 to protrude from the heated band 310, and increase cable surface area in contact with the heated object. The term oversized refers to the cable outer diameter $d_c$ being equal to or greater than the heated band inner diameter $d_b$. This reduces and/or removes gaps between the cable 312 and the heated object when the associated band heater assembly is connected to the heated object. The channel opening width u is less than or equal to the heated band inner diameter $d_b$. This also minimizes gaps between the cable 312 and the heated object.

The heated band width I is equal to or greater than the heated band height h. The heated band width I is sized to provide efficient heat transfer from the heated band 310 to the heated object while minimizing the amount of material associated with the heated band 310 and heat loss to atmosphere. As the heated band width I is increased, contact surface area between the heated band 310 and the heated object increases.

The heated band height h is less than or equal to the heated band inner diameter $d_b$ plus twice the heated band thickness t, as shown by equation 1.

$$h \leq d_b + 2t \tag{1}$$

The relationship provided by equation 1 provides a protrusion height that allows for consistent and continuous contact of the heated band 310 with the heated object.

In FIG. 16, a block diagram of a HVAC system 420 incorporating a band heater assembly 422 is shown. The HVAC system 420 includes a circuit 422 with a compressor 424, a condenser 426, a drier 428, a metering device 430, and an evaporator 432. The compressor 424 has a crankcase or housing 434 and pumps a refrigerant through the circuit 422 at predetermined flow rates ad pressures. The compressor 424 includes a low-pressure side and a high-pressure side. Refrigerant vapor is received on the low-pressure side in a first state and is discharged on the high-pressure side in a second state towards the condenser 426. The refrigerant is at a higher temperature when in the second state than when in the first state. Air flowing through the condenser 426 absorbs thermal energy from the refrigerant vapor and causes the refrigerant vapor to condense.

High-pressure refrigerant liquid flowing from the condenser 426 is passed through a filter drier 428 to remove contaminants. After the filter drier 428, the high-pressure refrigerant liquid may be received by the metering device 430, which divides high-pressure and low-pressure sides of the circuit 422. The metering device 430 may be used to maintain a specific rate of flow of refrigerant to the evaporator 432. The refrigerant drops in pressure and temperature through the metering device 432. The refrigerant is evaporated in the evaporator 432 and cools air flowing over the evaporator 432. Heat in the air flowing over the evaporator 432 is absorbed by the refrigerant.

The HVAC system 420 also includes a band heater system 450 that includes a band heater assembly 452, such as one of the band heater assemblies described herein, sensors 454, a control module 456 and a power source 458. The band heater assembly 452 is connected to the housing and receives current from the control module 456. The control module 456 monitors signals from the sensors 454 and based on the signals transfers power from the power source 458 to the band heater assembly 452. The control module 456 may adjust the current and/or voltage applied to the band heater assembly 452 based on the signals received from the sensors 454. The control module 456 may also control the flow rate of the refrigerant through the metering device 432.

The sensors 454 may include, for example, temperatures sensors, thermostats, pressure sensors, flow rate sensors, etc. The sensors 454 may detect temperatures, pressures, and flow rates at various points of the circuit 422. The sensors 434 may also be used to detect and/or estimate the temperature of the band heater assembly 452. A sensor may, for example, detect the temperature within the crankcase 434 and/or may be connected to and directly detect the temperature of the band heater assembly 452. Temperature of the band heater assembly 452 may be indirectly estimated based on the current provided and/or voltage applied on the leads of the band heater assembly 452. The control module 456 may be used to detect shorts and/or open electrical circuits and/or degraded connections associated with the band heater assembly 452. Current and/or voltage to the band heater assembly 452 may be decreased when a fault is detected.

In use, the band heater assembly 452 may be maintained in an ON state. The band heater assembly 452 may be on when the compressor 424 is in an ON and/or OFF state. This maintains temperature of the compressor 424 above a predetermined temperature. In an alternative embodiment, the band heater assembly 452 may be in an ON state when the compressor 424 is in an OFF state and vice versa. The control module 456 may activate the band heater assembly 452 when the temperature of the compressor 424 is less then the predetermined temperature.

Figure 17:
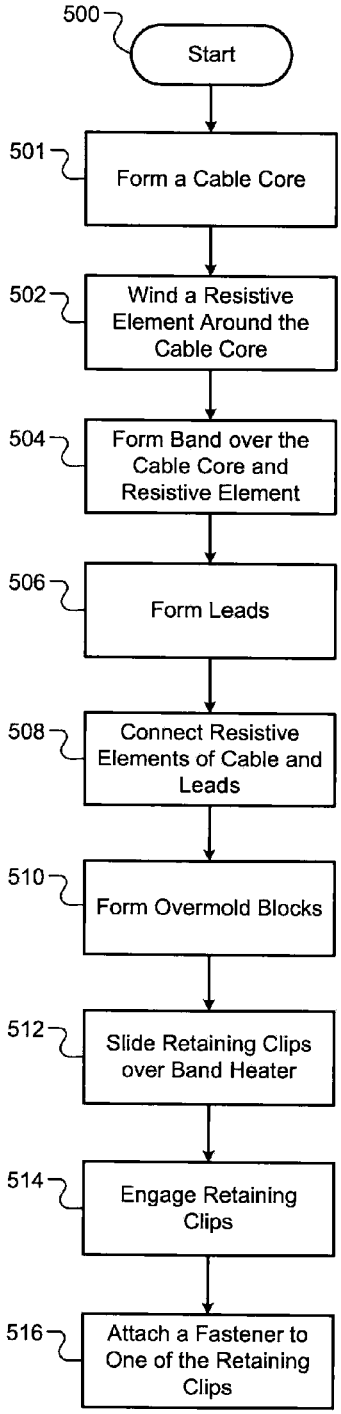
FIG. 17 illustrates a method of forming a band heater assembly in accordance with an embodiment of the present disclosure.

In FIG. 17, illustrates a method of forming a band heater assembly. Although the method of FIG. 17 is primarily described with respect to the embodiment of FIGS. 1-12, the method may be applied to other embodiments of the present disclosure. The method may begin at step 500.

In step 501, a core of a cable is formed. In step 502, a resistive element, such as a wire is coiled around the core. Gaps between coils may be adjusted per application. The resistive element may extend past ends of the core to allow for connection with leads. In step 504, a band may be formed and/or extruded over the core and the resistive element to form a band heater. The band may include one or more flanges and a center section that protrudes away from a contact surface of the band heater, which contacts a heated object when installed.

In step 506, the leads are formed and include respective resistive elements, such as lead wires. The resistive elements of the lead wires may be formed of different material than that of the resistive element of the band heater. This allows for heating of the resistive element of the band heater and not of the resistive elements of the leads. The leads may have respective insulative jackets that cover the resistive elements of the leads. The resistive elements of the leads may extend out of the jackets for connection with the resistive element of the band heater.

In step 508, the resistive element of the band heater is connected to the resistive elements of the leads. The resistive elements of the band heater and leads may be spliced and/or crimped together at respective junctions. In step 510, end block connectors, such as the overmold blocks 56, may be formed over ends of the band heater, the junctions and ends of the leads.

In step 512, retaining clips, such as the retaining clips 58, may be slid onto the band heater. In step 514, the retaining clips are engaged with the end block connectors. In step 516, a fastener, such as the fastener 60, may be attached to one of the retaining clips.

Figure 18:
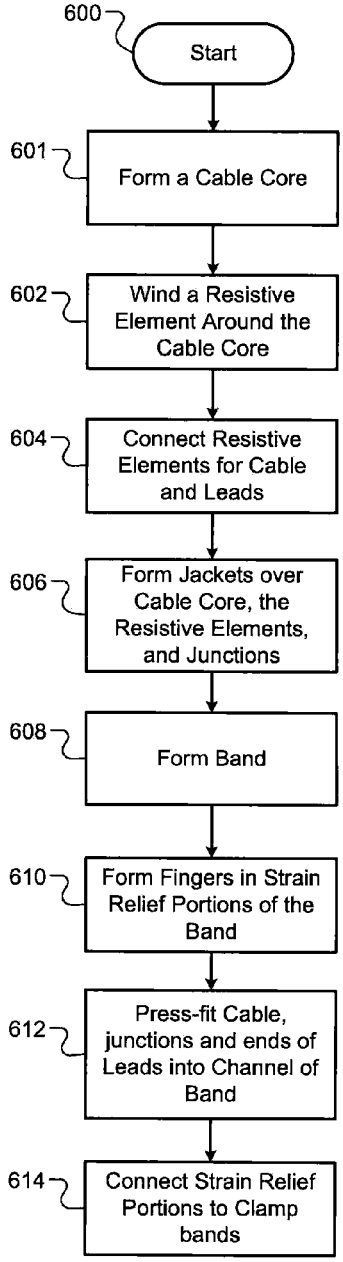
FIG. 18 illustrates a method of forming a band heater assembly in accordance with another embodiment of the present disclosure.

In FIG. 18, illustrates another method of forming a band heater assembly is shown. Although the method of FIG. 18 is primarily described with respect to the embodiment of FIGS. 13-15, the method may be applied to other embodiments of the present disclosure. The method may begin at step 600.

In step 601, a core of a cable is formed. In step 602, a first resistive element, such as a wire is coiled around the core. Gaps between coils may be adjusted per application.

In step 604, ends of the first resistive element are connected to ends of second and third resistive elements of leads at respective junctions. The second and third resistive elements may have jackets or the jackets of the leads may be formed in step 606. The second and third resistive elements may be formed of different material than that of the first resistive element. This allows for heating of the band heater and not of the leads.

In step 606, one or more jackets may be formed and/or extruded over the core, first, second and third resistive elements, and junctions. In step 608, a band is formed and/or extruded to include one or more flanges and a center section with an open channel. In step 610, fingers are formed in strain relief portions of the band.

In step 612, one or more of the cable, junctions, and ends of the leads are press-fit into the channel. In step 614, the strain relief portions are connected to clamp bands, such as the clamp bands 320, 322. Band heater engaging sections of the clamp bands are applied to the strain relief portions. The fingers are folded over notches in the band heater engaging sections and crimped to lock the clamp bands to the heated band. This prevents movement between the band heater and the clamp. As the fingers are bent over and crimped to the clamp bands, edges of the fingers do not extend laterally from the band heater, which increases safety in handling of the band heater assembly.

The above-described steps of FIGS. 17 and 18 are meant to be illustrative examples; the steps may be performed sequentially, synchronously, simultaneously, continuously, during overlapping time periods or in a different order depending upon the application.

Figure 19:
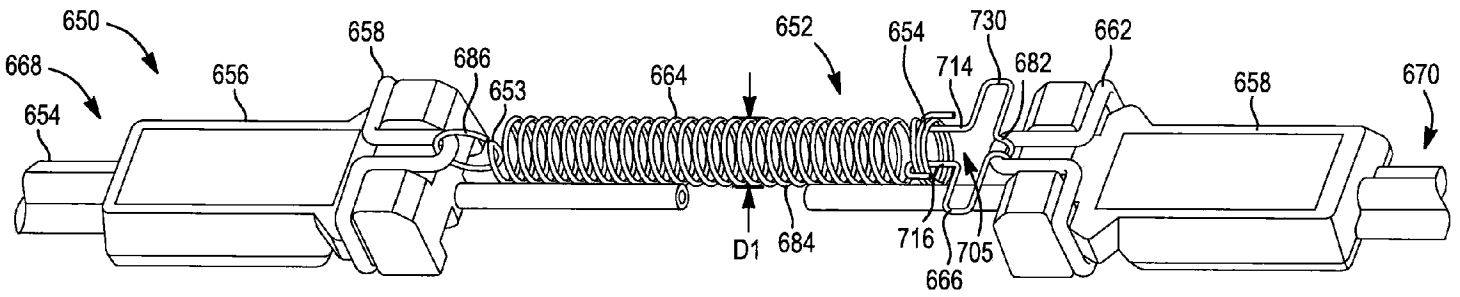
FIG. 19 is a perspective view of a band heater assembly incorporating a tension adjustment assembly in accordance with an embodiment of the present disclosure.
Figure 20:
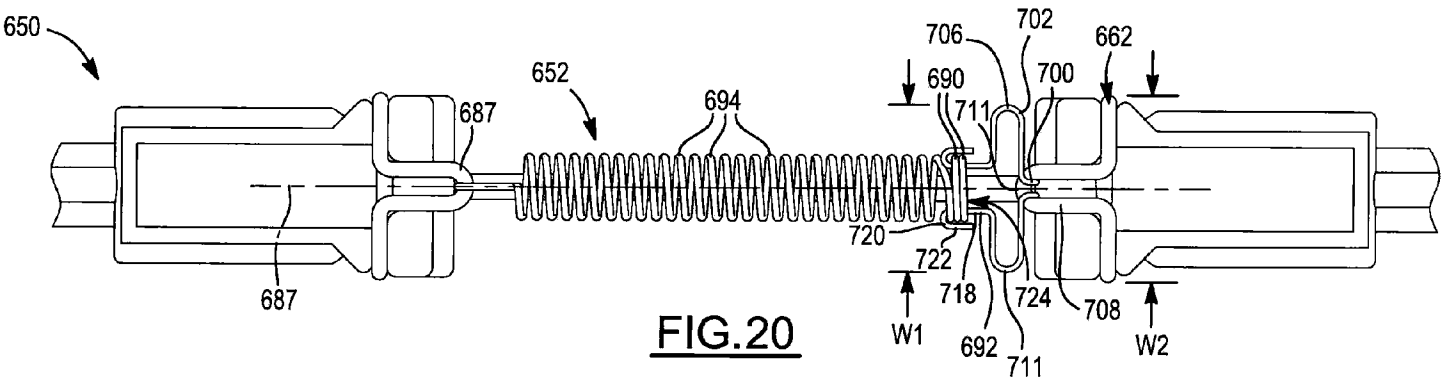
FIG. 20 is a top view of the band heater assembly of FIG. 19.
Figure 21:
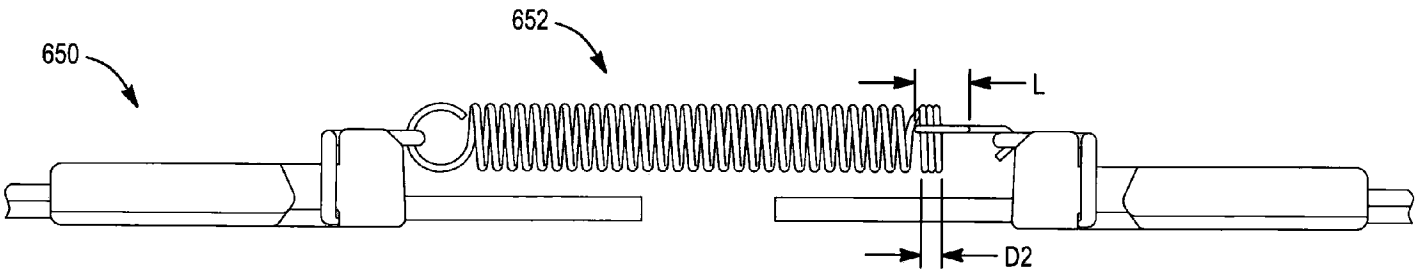
FIG. 21 is a side view of the band heater assembly of FIG. 19.

In FIGS. 19-21, a band heater assembly 650 is shown with a tension adjustment assembly 652. Although the band heater assembly 650 is shown as including a particular band heater 654, overmold blocks 656, 658 and retaining clips 660, 662, the band heater assembly 650 may include other band heaters, overmold blocks and retaining clips disclosed herein. Other band heater assembly elements are shown, for example, in FIGS. 1-15. The tension adjustment assembly 652 may be adjusted in tension and length to accommodate for different band heaters and different applications having associated tension requirements. The applications may refer to the objects on which a band heater assembly may be applied. The adjustability of the tension adjustment assembly 652 increases ease and decreases time associated with installation of a band heater assembly on an object. The adjustability also minimizes the number of different sized fasteners, such as various sized springs, used in a band heater assembly.

The tension adjustment assembly 652 may include first and second adjustment assembly ends 653, 654. The first adjustment assembly end 653 is connected to the first retaining clip 660. The second adjustment assembly end 654 is connected to the second retaining clip 662. The tension adjustment assembly 652 is attached to first and second heater ends 668, 670 of the band heater 654 via the retaining clips 660, 662. The tension adjustment assembly 652 includes a fastener 664 (i.e. biasing member) and a tension adjustment handle 666. The tension adjustment handle 666 may be rotated to adjust tension of the fastener 665 (e.g., spring force), which corresponds or is equal to the retaining force applied on the band heater 654. The retaining force holds the first and second heater ends 668, 670 a fixed distance from each other after installation onto the object. Rotation of the tension adjustment handle 666 also adjusts length of the fastener 664. The tension adjustment handle 666 may be rotated by hand without use of tools. The retaining force is provided to maintain the band heater 654 in a fixed position on an object. The retaining force also aids in maintaining surface area contact between the band heater 654 and the object.

The fastener 664 may, for example, be an extendable spring, as shown. The diameter, length, thickness and rate of the spring may vary per application. The fastener 665 may include an extended section 684 (first section) and an unextended section 685 (second section). In its operable state, the extended end 684 is in tension and the unextended end 685 is in a relaxed state. The extended section 684 includes the first adjustment assembly end (first fastener end) 653. The first adjustment assembly end 653 may include a hooked coil 686. The hooked coil extends perpendicular to other coils of the fastener 664, toward and away from a centerline 687 of the fastener 664, and crosses the centerline 687. The hooked coil 686 may connect to a center section 687 of a first retaining clip 688 on the first heater end 668. A second fastener end 654 of the fastener 664 is connected to the tension adjustment handle 666 and includes a first set of coils 690 (e.g., coils 1-N, where N is an integer greater than or equal to 1). The first set of coils 690 are wound on a coil retaining portion 692 of the tension adjustment handle 666. The extended section 684 includes a second set of coils 694 (e.g., coils 1-M, where M is an integer greater than or equal to one).

The number of coils in the first set of coils 690 may be adjusted at the same time as the adjustment in the number of coils in the second set of coils 694, by rotation of the tension adjustment handle 666. The number of coils N increases and the number of coils M decreases when the tension adjustment handle 666 is rotated in a first direction. The number of coils N decreases and the number of coils M increases when the tension adjustment handle 666 is rotated in a second or opposite direction as that of the first direction. To increase tension in the fastener 664 and/or the extended section 684 the tension adjustment handle is rotated to decrease the number of coils M and increase the number of coils N.

The tension adjustment handle 666 when rotated about the centerline 687 adjusts tension in the extended section 684 between the first retaining clip 658 and the tension adjustment handle 666. The tension adjustment handle 666 may be threaded into the fastener 664, as opposed to being welded or crimped directly onto the fastener 664. The tension adjustment handle 666 may be formed of metal, plastic, ceramic, etc and be of various shapes.

The tension adjustment handle 666 may be 'T'-shaped and include a retaining clip portion 700 (head), a handle portion 702 (body), and the coil retaining portion 692. The retaining clip portion 700 may include a hooked center section 706 to attach to the second retaining clip 662. The retaining clip attachment portion 706 may be inserted into or through a center section 708 of the second retaining clip 662, such as into a hole or slot 710 of the center section 708.

The handle portion 702 has extensions 711 with a corresponding overall width W1 that is measured perpendicular to the centerline 687. The extensions 711 extend away from the centerline 687 and passed the first set of coils 682. The width W1 is greater than the diameter D1 of the fastener 664. The extensions 711 may be grasped by an installer and used to rotate the tension adjustment handle 666. The overall width W1 may be less than, approximately equal to, or greater than the width W2 of the overmold blocks 656, 658. The longer the extensions 711, the less force is used to rotate the tension adjustment handle 666 and adjust the number of coils on the coil retaining portion 692. The extensions 711 may be grasped by an installer and used to stretch the fastener 664 when installing the band heater assembly 650.

The coil retaining portion 692 may extend longitudinally from the handle portion 702, parallel to the center line 687, and attach to the second end of the fastener 682. The centerline 687 may extend between the first and second fastener ends 680, 682. The coil retaining portion 692 may include first and second coil holding members 714, 716 (engagement loops). The coil holding members 714, 716 may be hooked and extend longitudinally into, laterally outward, and between coils of the fastener 664.

Each of the coil holding members 714, 716 may include an internal segment 718, a lateral segment 720 and an external segment 722. The internal segment 718 extends longitudinally in parallel with the centerline 687 into a center 724 of the fastener 664 for a first predetermine distance D2. The lateral segment 720 extends from the internal segment 718, laterally away from the centerline 687, and between coils of the fastener 664. The external segment 722 extends from the lateral segment 720 in an opposite direction as the internal segment 718.

Length L of the coil holding members 714, 716 may be adjusted based on a predetermined number of coils that may be included in the first set of coils 690. The length L may be adjusted per application (i.e., the band heater assembly used and the object to which the band heater assembly is applied), the retaining force desired for the application, the fastener used, etc. The length L may be set to accommodate one or more coils of the fastener 664. The coils of the fastener 664 are threaded through and between segments of the coil holding members 714, 716. Also, the distance between the coil holding members 714, 716 may be adjusted per application. Although the coil holding members 714, 716 are shown as being disconnected from each other near the second fastener end 654, the coil holding members 714, 716 may be formed together as a unitary structure.

The first set of coils 690 is held between the internal segments 718 and the external segments 722 in a lateral direction away from the centerline 687. The first set of coils 690 are also held between the extensions 711 and the center segments 720 in a longitudinal direction that is parallel to the centerline 687.

The portions 692, 700, 702 may be distinct components or may be integrally formed as a single component, as shown. The portions 692, 700, 702 may include an inner opening 705 between the extensions 711 and the coil holding members 714, 716, as shown, or may be formed as a unitary structure without an opening.

In one embodiment, the tension adjustment handle 666 includes a handle wire 730, which is shaped to form the portions 692, 700, 702. The handle wire 730 may be formed, for example, from cold rolled steel, aluminum, and/or other metallic or non-metallic materials. The tension adjustment handle 666 may be symmetrical about the centerline 687.

Figure 22:
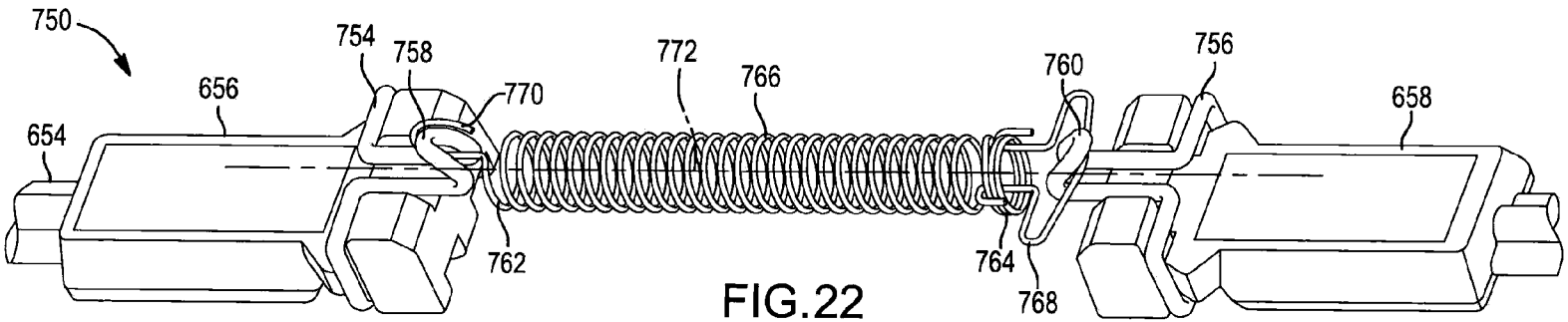
FIG. 22 is a perspective view of another band heater assembly incorporating another tension adjustment assembly in accordance with an embodiment of the present disclosure.
Figure 23:
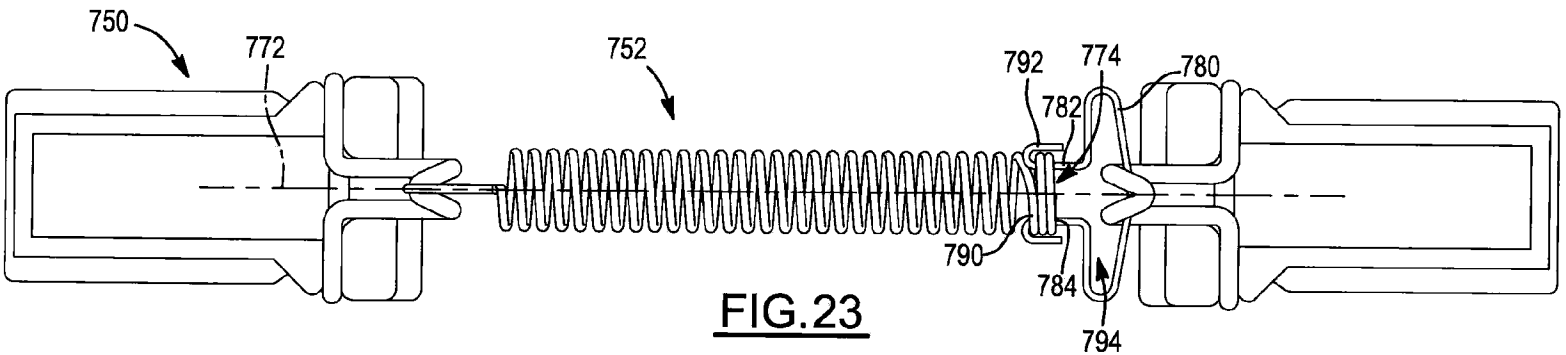
FIG. 23 is a top view of the band heater assembly of FIG. 22.
Figure 24:
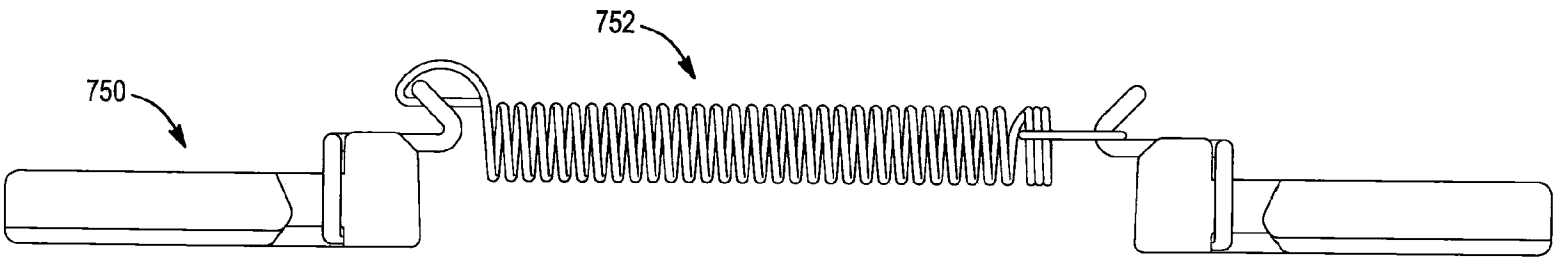
FIG. 24 is a side view of the band heater assembly of FIG. 22.

In FIGS. 22-24, a band heater assembly 750 is shown with a tension adjustment assembly 752. The band heater assembly 750 is similar to the band heater assembly 650. The band heater assembly 750 includes the band heater 654 and the overmold blocks 656, 658. The band heater assembly 750 includes first and second hooked retaining clips 754, 756. Hooked center sections 758, 760 of the retaining clips 754, 756 engage with the tension adjustment assembly 752. The tension adjustment assembly 752 includes first and second adjustment assembly ends 762, 764, a fastener 766, and a tension adjustment handle 768.

The first adjustment assembly end 762 includes a hooked coil 770 that extends longitudinally along a centerline 772, perpendicular to other coils of the fastener 766, and does not cross the centerline 772. The hooked coil 770 is hooked outward away from the centerline 772. The centerline 772 extends longitudinally and through a center 774 of the fastener 766. The second adjustment assembly end 764 is connected to the tension adjustment handle 768. The tension adjustment handle 768 includes a retaining clip portion 780, a handle portion 782, and a coil retaining portion 784. The retaining clip portion 780 includes an un-hooked center section 782 that is connected to the center section 760 of the second retaining clip 756. The coil retaining portion 784 is connected to the fastener 766 and includes coil holding members 790, 792.

The un-hooked center section 782 may be bowed away from the coil holding members 790, 792 to ease alignment and attachment to the center section 760 of the second retaining clip 756. The center section 760 may be hooked to extend laterally away from the second overmold block 658, through an opening 794 of the tension adjustment handle 752, and around the retaining clip portion 780.

Figure 25:
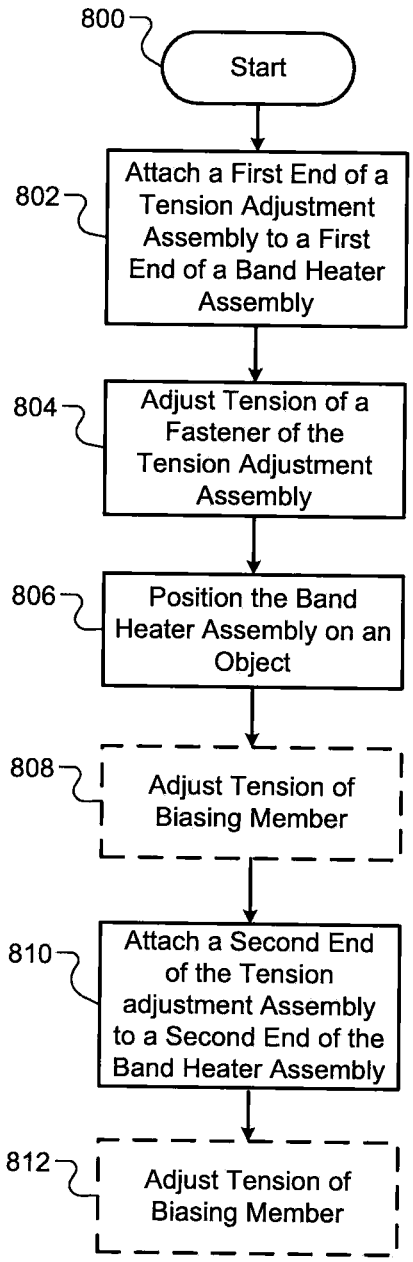
In FIG. 25, illustrates a method of attaching a band heater assembly to an object including adjustment of retaining force for a band heater.

In FIG. 25, a method of attaching a band heater assembly to an object including retaining force adjustment of a band heater is shown. Although the method of FIG. 25 is primarily described with respect to the embodiments of FIGS. 19-24, the method may be applied to other embodiments of the present disclosure. The method may begin at step 800.

In step 802, a first adjustment assembly end of a tension adjustment assembly, such as one of the first ends 653 and 762, is attached to a first heater end of a band heater assembly and/or first retaining clip. This may include the hooking of the first end onto a center section of the first retaining clip, such as onto one of the center sections 687 and 758.

In step 804, tension of a fastener, such as one of the extended sections of the fasteners 664 and 766, of the tension adjustment assembly is adjusted. The tension may be pre-adjusted before attaching of the band heater assembly to the object. The tension may be adjusted by rotation of a tension adjustment handle. The tension adjustment handle may be rotated to coil a predetermined number of coils on a coil retaining section. An example of a predetermined number of coils is shown by the first set of coils 690. A coil may be shared by both extended and unextended sections of a fastener. For example, a coil may include first and second portions. The first portion may be coiled onto the coil retaining section and be part of a first set of coils. The second portion may remain as part of a second set of coils in the extended section.

The tension level may be preset by a manufacturer. The tension level of the fastener may be set within a tension range having a low end and a high end. The low end may be set to assure that the band heater assembly is secured to the object. The high end may be set to prevent the tension level from exceeding a tension limit of the fastener.

In step 806, the band heater assembly is positioned over an object in predetermined and/or desired vertical and horizontal directions relative to the object. This may include, for example, the wrapping of a band heater around a crankcase, as shown in FIG. 1.

In step 808, tension of the extended portion of the fastener may be further adjusted before step 810. For example, a user may determine that a tension level of the extended portion is less than or greater than a predetermined and/or desired tension level before attachment to the second end of the band heater assembly and/or a second retaining clip. This may be determined, for example by the number of coils in the first and second set of coils, the overall length of the tension adjustment assembly, the application of the band heater assembly, etc.

In step 810, the second adjustment assembly end of the tension adjustment assembly is attached to the second heater end of the band heater assembly and/or the second retaining clip. This may include: A) the pulling of one or more of the first adjustment assembly end and the second heater end toward each other; B) the slipping of the center section of the tension adjustment handle over the center section of the second retaining clip; and C) the releasing of one or more of the first adjustment assembly end and the second heater end. The first adjustment assembly end or the second retaining clip may be hooked to connect to the other one of the first adjustment assembly end and the second retaining clip.

In step 812, tension of the fastener may be further adjusted for various reasons. For example, a user may determine that the tension level is less than or greater than the predetermined and/or desired tension level after attachment to the second heater end. This may be determined when attaching the band heater assembly to the object and/or after an extended or predetermined period of time from when the band heater assembly is attached to the object.

As another example, the fastener may set over time, resulting in a decrease in the tension level of the fastener to a tension level that is less than the predetermined and/or desired tension level. This may be due to an operating environment and temperatures of the band heater assembly. The decrease in tension level may also be due to structural and/or material changes in the fastener and/or other elements of the band heater assembly over time. To adjust the tension, a user may: 1) detach the tension adjustment handle from the second heater end and/or second retaining clip; 2) adjust the tension level by rotation of the tension adjustment handle; and 3) reattach the tension adjustment handle to the second heater end and/or second retaining clip.

The above-described steps of FIG. 25 are meant to be illustrative examples; the steps may be performed sequentially, synchronously, simultaneously, continuously, during overlapping time periods or in a different order depending upon the application.

The above described embodiments provide band heater assemblies with efficient thermal energy transfer characteristics. The band heater assemblies provide direct contact between a cable and a heated object and provide consistent and continuous contact in longitudinal and lateral directions with a heated object. This minimizes gaps and reduces temperature of band heater contact surface temperatures, which increases life of the band heater assemblies. The band heater assemblies are designed to minimize material and manufacturing costs and complexity.

The broad teachings of the disclosure can be implemented in a variety of forms. Therefore, while this disclosure includes particular examples, the true scope of the disclosure should not be so limited since other modifications will become apparent upon a study of the drawings, the specification, and the following claims.

What is claimed is:

1. A band heater for heating an object, comprising:

a flexible cable having a working length, the cable including an electrically resistive element helically wound around a dielectric core over the working length for generating thermal energy when an electrical current from a power source is passed therethrough, and a jacket encapsulating the core and the resistive element over the working length for electrically insulating the cable;

a flexible cover integrally formed as a part of the cable over the working length, the cover including a flange positioned adjacent the cable over the working length, the flange including a substantially flat yet accommodating bottom surface configured to follow an outer periphery of the object to be heated when the band heater is mounted thereto;

an end block overmolded on opposite ends of the cable, each end block encapsulating the ends of the cable and an electrical junction connected thereto, each end block further encapsulating an end of an electrical lead connected to the electrical junction, each of the electrical leads extending from within each end block and configured for connection to a power source for energizing the electrically resistive element;

first and second retaining clips, each removably retained by respective ones of the end blocks, the first and second retaining clips oriented toward one another when the band heater is mounted on the object to be heated; and a tensioner having a first end detachably connected to and retained by the first retaining clip and a second end configured to detachably connect to the second retaining clip, the tensioner configured to bias the end blocks toward one another when the band heater is mounted on the object to be heated.

2. The band heater of claim 1, wherein the tensioner includes a spring.

3. The band heater of claim 1, wherein the first and second retaining clips are removably retained by recesses formed in an outer portion of each respective end block.

4. The band heater of claim 3, wherein the recesses are integrally formed as a part of the end blocks.

5. The band heater of claim 1, wherein the working length corresponds to a distance between respective end blocks.

6. The band heater of claim 1, wherein the cover electrically insulates the electrically resistive element.

7. The band heater of claim 1, wherein the core includes a fiberglass.

8. The band heater of claim 1, wherein the jacket includes a silicone rubber.

9. The band heater of claim 1, wherein the cover includes a silicone rubber.

10. The band heater of claim 1, wherein the end blocks includes a silicone rubber.

* * * * *